US006685518B1

(12) United States Patent
Goudey

(10) Patent No.: US 6,685,518 B1
(45) Date of Patent: Feb. 3, 2004

(54) BUOYANT DEVICE THAT RESISTS ENTANGLEMENT BY WHALES AND BOATS

(75) Inventor: Clifford A. Goudey, Newburyport, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 10/279,784

(22) Filed: Oct. 24, 2002

(51) Int. Cl.[7] ..... B63B 22/00

(52) U.S. Cl. ..... 441/1

(58) Field of Search ..... 441/1, 3, 6, 23, 441/26; 43/4.5

(56) References Cited

U.S. PATENT DOCUMENTS

| | | | | | |
|---|---|---|---|---|---|
| 2,553,798 | A | | 5/1951 | Deventer | |
| 2,790,187 | A | | 4/1957 | Marconi | |
| 3,076,983 | A | * | 2/1963 | Wait, Jr. | 441/23 |
| 3,506,841 | A | * | 4/1970 | Majkrzak | 441/11 |
| 3,517,399 | A | * | 6/1970 | Horowitz et al. | 441/23 |
| 3,590,408 | A | | 7/1971 | Verhagen | |
| 3,942,203 | A | | 3/1976 | Perkins | |
| 4,249,277 | A | | 2/1981 | Plante | |
| 4,781,636 | A | * | 11/1988 | Schurr | 441/6 |
| 4,927,394 | A | | 5/1990 | Galgana | |
| 4,995,842 | A | | 2/1991 | Beyer-Olsen | |
| 5,360,359 | A | * | 11/1994 | Reynolds | 441/6 |
| 5,443,408 | A | | 8/1995 | Kimball | |
| 5,445,103 | A | * | 8/1995 | Bleth et al. | 441/3 |
| 5,514,016 | A | | 5/1996 | Larson | |
| 5,913,670 | A | | 6/1999 | Anderson et al. | |
| 5,987,710 | A | | 11/1999 | Paul et al. | |
| 6,357,162 | B1 | | 3/2002 | Torngren | |
| 2002/0106948 | A1 | | 8/2002 | deDoes | |

FOREIGN PATENT DOCUMENTS

| | | |
|---|---|---|
| CA | 835677 | 3/1970 |
| SE | 465956 | 1/1969 |

OTHER PUBLICATIONS

Goudey, Clifford A. et al., "Field Trials of the Whale–Free Buoy," http://www.northeastconsortium.org/proj_des_2001/Goudey_whale_free_buoy_summary.html, believed to have been posted during Nov. of 2001. Project details are alternatively accessed via http://www.northeastconsortium.org/Project?id=131&fopener=ProjectList, then clicking on *Buoy Project Summary Nov. 2001.*

* cited by examiner

*Primary Examiner*—S. Joseph Morano
*Assistant Examiner*—Lars A Olson
(74) *Attorney, Agent, or Firm*—Steven J. Weissburg

(57) ABSTRACT

A buoy reduces the risk of whale entanglement in fixed fishing gear and other equipment. The buoy is a replacement for a conventional buoy used to mark and to facilitate the retrieval of the gear. One embodiment has a relatively long flexible tapered stem at the buoy's line end. It may be made from PVC (polyvinyl chloride), which is the same material used to make common inflatable buoys and marine fenders, or any other suitably flexible, durable material. The free end of the buoy is shaped like a conventional lobster pot buoy, having a generally constant diameter, and a generally constant flexibility over its constant diameter. This free end meets the tapered line end at a transition region. The long stem is tapered and provides a stiffness profile having a gradual transition from the buoy line's extreme flexibility to the more rigid, buoyant body portion of the buoy. The free end may be relatively solid, like a conventional lobster pot buoy, or, it may be hollow. The entire buoy may be roto-molded in one piece, or, it may be made by joining a free end portion that is very similar to a conventional lobster pot buoy, to a molded, tapered line end portion.

54 Claims, 12 Drawing Sheets

S
110
200
28
26
W
122
108
F
121

BUOYANT DEVICE THAT RESISTS ENTANGLEMENT BY WHALES AND BOATS

GOVERNMENT RIGHTS

The United States Government may have certain rights in this invention pursuant to DOC/NOAA award #NA16FL1324.

A partial summary is provided below, preceding the claims.

The inventions disclosed herein will be understood with regard to the following description, appended claims and accompanying drawings, where:

BRIEF DESCRIPTION OF THE DRAWINGS

FIG. 7H; and returns to the surface (FIG. 7I);

DETAILED DESCRIPTION

Figure 1B:
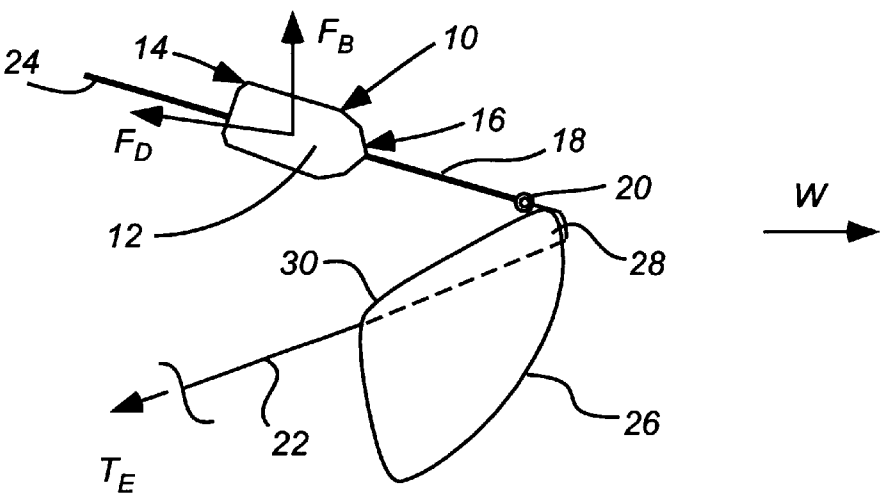
FIG. 1B is a schematic rendition showing interaction between a whale fin and a conventional buoy and line as the whale continues to move forward and the line begins to wrap around the fin.

Various species of whales inhabit waters in which commercial fishing is conducted, and in which pleasure and commercial vessels navigate. On occasion, whales become entangled with different components of fishing equipment. Such equipment includes, but is not limited to flotation buoys that mark the location of underwater equipment, such as passive and other fishing gear, and which are connected to the underwater equipment by a stout line. The underwater equipment can be lobster traps (pots), crab traps, various types of fishing nets, long lines, underwater pens used in fish farms and other types of aquaculture facilities. Less frequently, the underwater equipment can be scientific equipment. Additionally, floating buoys are used to mark open navigation channels, underwater hazards, such as rocks and wrecks, and mooring anchorages in harbors and other places where boats are anchored. Deep-sea exploration operations for oil and other natural resources also use anchored floats for various purposes.

In many cases, the underwater equipment is extremely massive. For instance, linear arrays (called trawls) of lobster pots as long as 30 pots or more can be connected in series. If not so massive in their own right, the underwater equipment is frequently of a shape that may become anchored, or lodged between other underwater obstructions or terrain. The lines that connect the equipment to the buoy are extremely strong and durable, designed to withstand the forces experienced by tides and storms for many years and the forces required to periodically retrieve the equipment.

If a whale happens to encounter the line that connects a flotation buoy to such equipment, the whale may become entangled with the line, either at the whale's pectoral fin or its tail fluke, or even its mouth. Many species of whales, particularly baleen whales, such as the Right whale, which is an extremely endangered animal, feed by moving slowly through the water with their huge mouths agape, swallowing extensive quantities of krill and other small marine animals. They can easily close their mouths around such equipment lines without initially noticing.

When the whale notices that it has encountered a line or obstruction, it may attempt to free itself by wriggling or whirling or rapidly changing its course, or by moving more forcefully generally forward. Any such action can cause additional, more severe entanglement with the line and buoy. Entanglement may result in the whale becoming confused, and further entangled. The whale, being very strong and massive, may be able to drag the equipment with it in some cases. Or, if not, the whale may become injured by the cutting action of the rope on its body, or may drown, if prevented from surfacing due to the anchoring effect of the equipment. Even if the whale does drag the equipment along, the whale is disadvantaged by this excess baggage, which, eventually may become lodged in such a way that the whale can no longer move forward, at which point, it may struggle, and become injured by cutting, or additional entanglement, leading to drowning.

The fishing industry is interested in using equipment that will minimize harm to whales. Further, the industry is interested in using equipment that will not be damaged or lost due to whale entanglement.

A general class of solutions to the problem is flotation buoy systems that break away from the equipment, in some fashion. This solution may save the whales, but it results in loss of the equipment and the flotation buoy. Further, it is rather expensive for each device. Further, it is prone to accidental activation, thereby resulting in needless equipment (and buoy) loss.

A related problem with flotation buoys is that they sometimes become entangled or otherwise interact with parts of boats, particularly their keels, rudders, shafts, shaft struts, and propellers. This may also result in loss or damage to the buoy, line or equipment, and damage to the boat, or, at the very least, propeller entanglement.

Thus, there is a significant need for an equipment line flotation device that will not promote entanglement with whales, and components of boats, and that does not result in the loss of the flotation buoy and/or the equipment to achieve this result. There is also a need for such an equipment line and float that avoids even any initial entanglement by a whale, thus avoiding a whale's potentially exacerbating evasive actions. It would also be helpful that in respects other than entanglement, a non-entangling buoy function very similarly to conventional buoys.

An aspect of an invention disclosed herein is a novel buoy that reduces the risk of whale entanglement in fixed fishing gear and other equipment. The device is a replacement for a conventional buoy used to mark and to facilitate the retrieval of the gear. In general, one embodiment of an invention has a relatively long flexible stem. It may be made from PVC (polyvinyl chloride), which is the same material used to make common inflatable buoys and marine fenders, or any other suitably flexible, durable material. Materials selection is discussed below. The long stem is tapered and provides a gradual transition from the buoy line's extreme flexibility to the more rigid, buoyant body portion of the buoy.

By contrast, current buoys have an abrupt intersection between the line and buoy or buoy stick. Without this abrupt intersection, a buoy of an invention hereof is able to slide free of most encounters with whales or other moving, potentially snagging bodies. The tapered shape may also facilitate its passing through the baleen of a whale if the entanglement initiates in the mouth.

The problem and the inventions disclosed herein that help to solve the problem are illustrated with reference to the figures. FIG. 1A shows, schematically, a known equipment flotation buoy 10, having a main body 12, which has a free end 14 and a line end 16. The line end has a rod 18 extending therefrom, which typically terminates in an eyelet 20, to which a line 22 is secured, by a suitable means, such as a knot, splice, or mechanical clamp or crimp of some sort. A pick-up rod 24 extends from the free end 14 of the main body to facilitate the fisherman or boat operator in grabbing or otherwise securing the buoy, and also to aid in its location. In some cases, radar reflective bodies are attached to the free end of the pick up rod.

A whale's pectoral fin (also called a flipper) 26 is shown schematically encountering the line 22. The whale's fin has a relatively compact, small diameter, root portion 28, from which fans out a generally planar, extended flipper portion 30. The whale, in this example, is moving along the direction of the arrow W, from left to right, as shown. The line 22 is shown in phantom wrapping rather tightly around the root portion 28, generally behind the more planar portion 30.

The line 22 extends downward, to an underwater location, where it is secured to some sort of underwater equipment, such as a lobster pot, fishing net, or measurement equipment. A tension $T_E$ arises in the line as a result of the whale's motion and the resistance to motion of the buoy and the equipment, among other forces. The buoy also experiences a buoyancy force, $F_B$, which acts directly upward, and a hydrodynamic drag force $F_D$, which acts in a direction that is in opposition to the motion of the buoy. This direction is the vector sum of the motion of the whale and the downward progression of the line 22 as it slides around the root portion 28. The direction of $F_D$ shown in FIGS. 1A and 1B is schematic only.

Figure 1A:
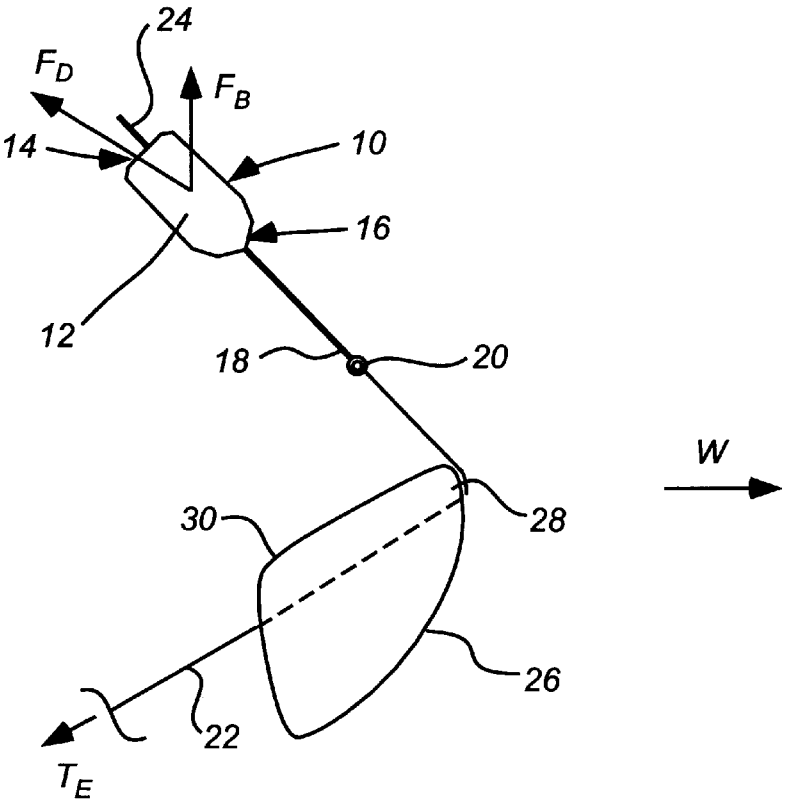
FIG. 1A is a schematic rendition showing interaction between a whale pectoral fin and a conventional buoy and line, with the fin contact with the line before the fin contacts the buoy itself.

FIG. 1B shows the situation as the whale continues to push against the line 22. The tension $T_E$ becomes larger, as the mass of the equipment, and any anchoring force associated with it due to mechanical locking within its environment, resist motion of the line and whale. The combined buoyant and hydrodynamic drag forces on the buoy keep the buoy tending backwards towards the tail of the whale. Because of the abrupt geometry of the intersection between the line 22 and the eyelet 20, there is insufficient torque resulting from tension $T_E$ to pull the buoy around the fin, in a clockwise directions, as shown, and the buoy is effectively trapped in its position at the whale's fin. Instead the tension causes the line and buoy to grip more severely around the root 28 of the fin. The eyelet 20 resists sliding motion (toward the equipment) of the line 22 around the root 28 of the flipper. The line 22 does not support any bending stress, and thus, the tension $T_E$ does not result in any torque around the fin root 28 in opposition to the torque that results from the drag force $F_D$.

Due to the significant difference in bending stiffness, at the interface between the line 22 and the line end rod 18, and the diameter discontinuity at the eyelet, it is very difficult for simple forward pushing of the whale to cause the eyelet 20, rod 18 and float body 12, to pass around the flipper 26. Even if the line end rod 18 is brought around the flipper root 28, the abrupt change in diameter at the intersection between the line end rod 18 and the flotation body 12 may present a further obstruction to buoy passage, especially as the larger buoy encounters the extended portions 30 of the flipper.

Figure 2B:
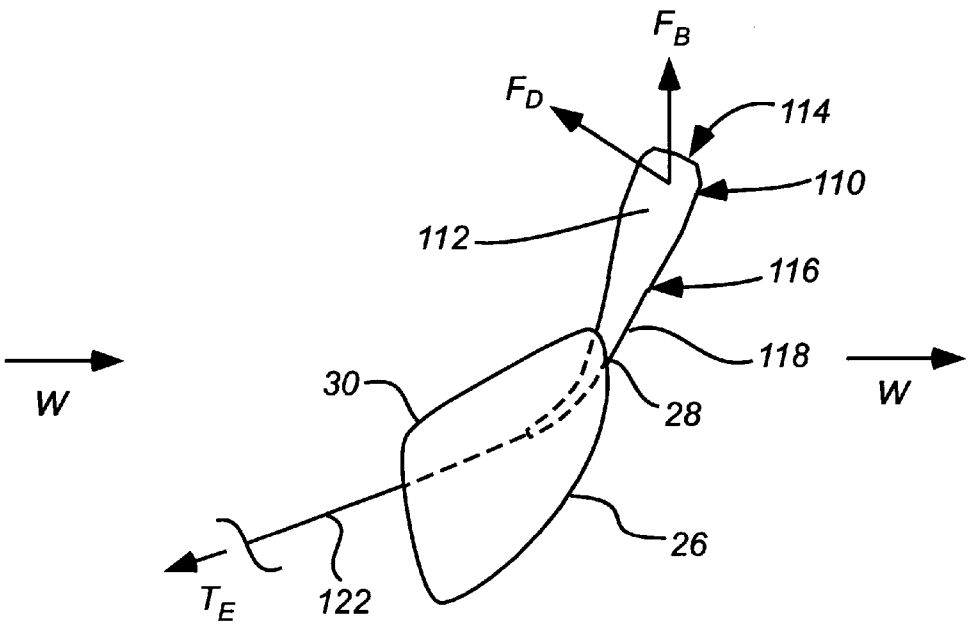
FIG. 2B is a schematic rendition showing interaction between a whale fin and a buoy that embodies an aspect of an invention disclosed herein, and line, as the whale moves forward.
Figure 2A:
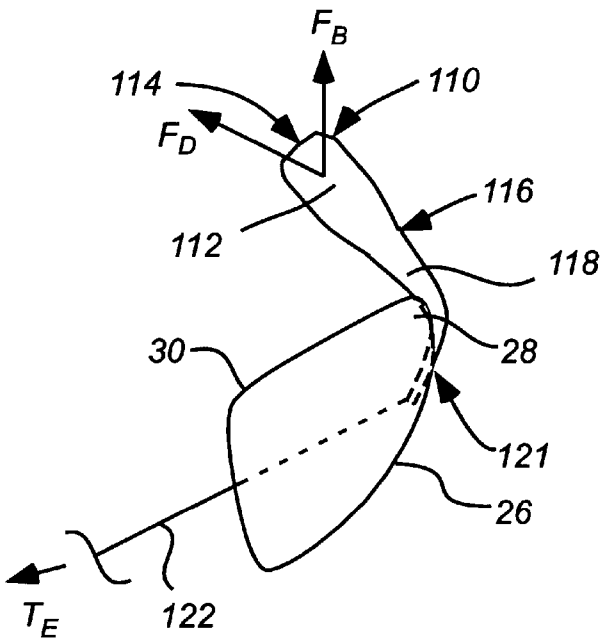
FIG. 2 is a schematic rendition showing interaction between a whale fin and a buoy that embodies an aspect of an invention disclosed herein, and line, as the buoy comes into contact with the fin.
Figures 3A, 3B, 3C:
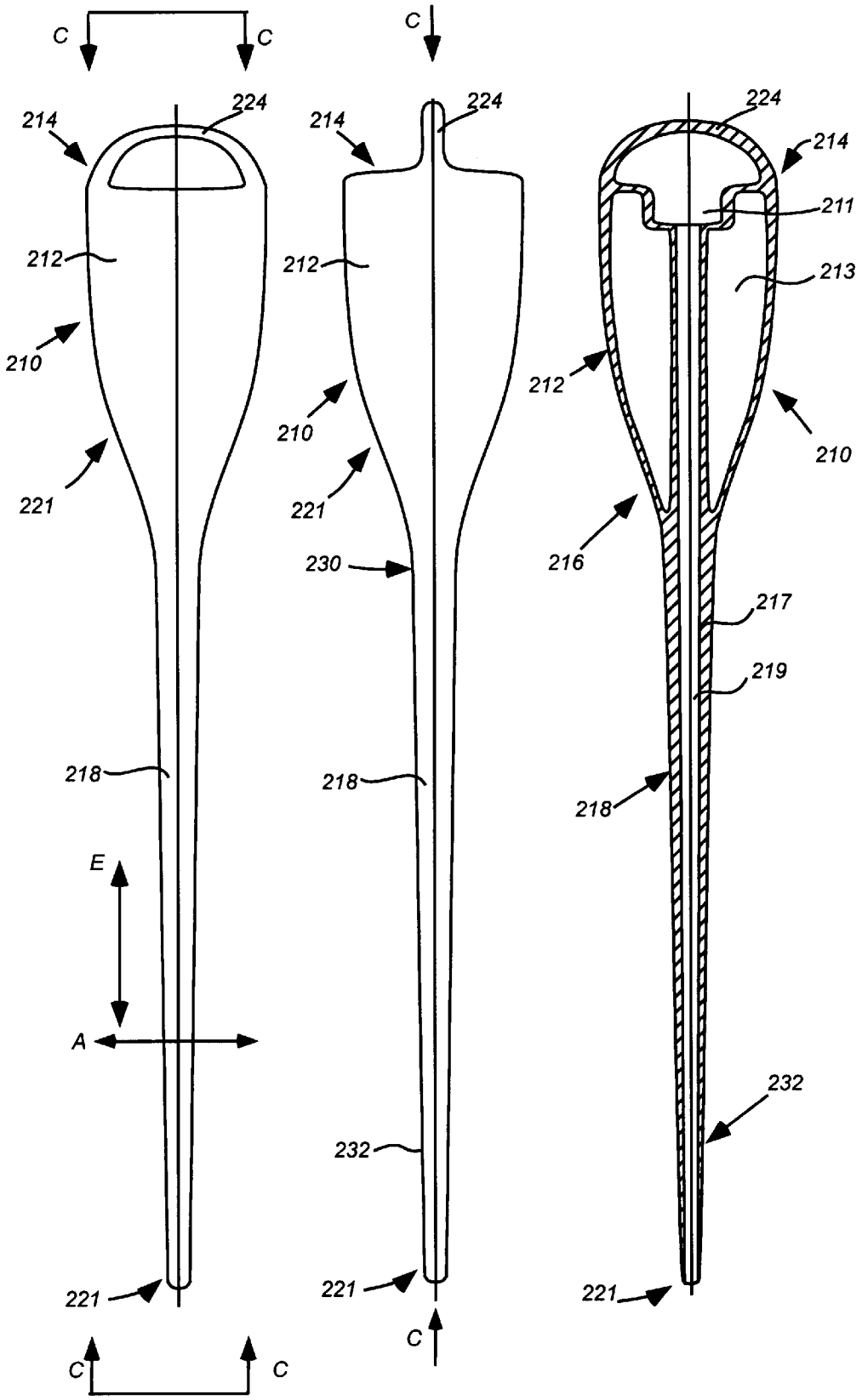
FIG. 3A is a front view of a buoy that embodies an aspect of an invention hereof.
FIG. 3B is a side view of the buoy shown in FIG. 3A.
FIG. 3C is a cross-sectional view of the buoy shown in FIG. 3B along the lines C—C.
Figure 4A:
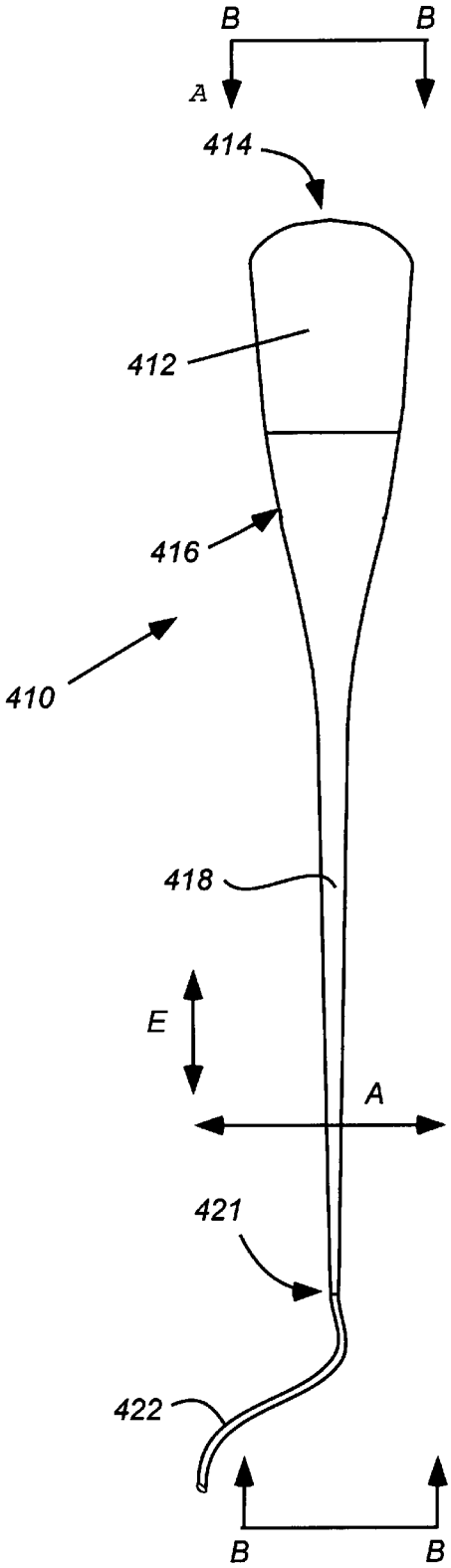
FIG. 4A is a schematic elevation view of a buoy that embodies an aspect of an invention hereof, having a solid body portion and a relatively gradual taper approaching its free end.
Figure 4B:
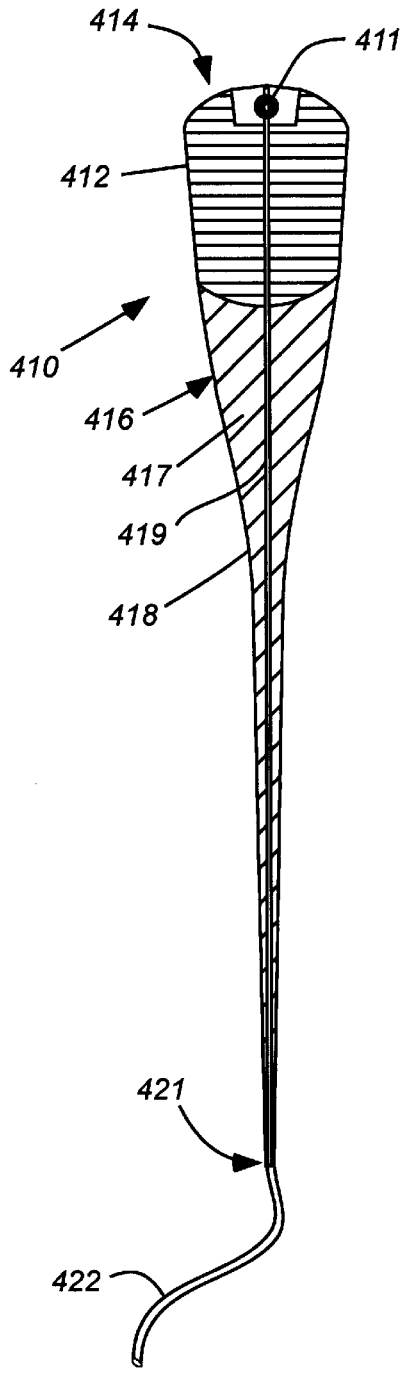
FIG. 4B is a cross-sectional view of the buoy shown in FIG. 4A, along the lines B—B.

FIGS. 2A and 2B show a generic embodiment of inventions disclosed herein. Two similar embodiments of inventions disclosed herein are shown with reference to FIGS. 3A, 3B and 3C on the one hand and FIGS. 4A and 4B on the other hand. FIGS. 3A–C show an embodiment having a relatively hollow main body portion and FIGS. 4A and 4B shown an embodiment having a relatively solid main body portion. The reference numerals for the generic illustrations in FIGS. 2A and 2B use a one hundred series. Similar items shown in FIGS. 3A–3C are identified with reference numerals that are offset by plus one hundred (two hundred series) from those identified in FIGS. 2A–2B. Similar items shown in FIGS. 4A–4B are identified with reference numerals that are offset by plus two hundred (four hundred series) from those identified in FIGS. 3A, 3B, and 3C.

A flotation buoy 110 has a free end 114 and a line end 121. The buoy 110 also has a relatively larger diameter body portion 112, that is coupled to its line end 121 by a gradually tapering stem portion 118. The body portion 112 is similar to a conventional buoy, having its free end, and a transition region 116, which is joined to the tapered portion 118.

As shown in FIG. 4B, with respect to a relatively solid body embodiment, the tapered portion 418 is hollow, having an annular solid portion 417. A hollow line chamber 419 runs from the line end 421 to the free end 414, opening up into an enlarged knot socket 411.

An equipment line 422, shown in FIG. 4B, is knotted, or otherwise secured to the buoy in the knot socket 411, and passes through the entire length of the line chamber 419, running out the end to the equipment below.

FIG. 4B shows a relatively solid body portion 412. Instead, as shown in FIG. 3C, the body portion 212 may have an internal hollow annular region 213. Whether the body portion is hollow depends on the needed buoyancy, the density, weight and cost of the material, and other factors. A grab handle 224 may be provided at the extreme free end 214 of the buoy, to enable the buoy being collected and placed. Alternatively, the buoy can be grabbed around its stem 218.

EXAMPLE

As shown in FIGS. 3A, 3B, and 3C, in a typical design, the outside diameter of the tapered region decreases from a maximum at the body portion 212 all the way to a minimum at the extreme line end 221. For instance, in one embodiment, the outside diameter of the body portion 212 at its widest is five inches (12.7 cm), just below the free end portion. The main body portion is approximately cylindrical, over the course of a length that is approximately equal to a diameter. After a significant diameter reduction at 230, the outer diameter is 1.2 inches (3.05 cm). Near to the line end at 232 it is 0.7 inches (1.78 cm) and at the very end at 221, it tapers down to 0.4 inches (1.02 cm). This is only slightly larger in diameter than the line that it is designed to be used with. The inner diameter of the solid annular region 217 (which is the same as the diameter of the hollow inner region 219) also tapers to be narrower at the line end 221. At 230, this inner diameter is 0.5 inches (1.27 cm) and at the very tip 221, it is 0.25 inches (0.63 cm). This typical geometry has an overall length of about 40 inches (102 cm) with a body portion, including the grab handle, being about 13 inches (33 cm) long. Of course, other geometries are possible, and this is just one that works well for securing lobster traps (pots) in New England.

FIG. 4B shows a buoy with a line 422 secured thereto. Typically, the nominal inner diameter of the hollow 419 is only slightly larger than the diameter of the line 422. At the extreme end 421 the hollow 419 may even be equal to or smaller in diameter than the line 422, to minimize the geometric transition from the line 422 to the buoy. In fact, in one mode of manufacture, the hollow is formed in an elastomeric material with a mold element (a tapered rod as a core) that has an outer diameter that is actually smaller than the outer diameter of the line. The line is then pulled through the hollow, and is forced through the opening, when the stem is in a relaxed state. The elastomeric material stretches (expanding outward) as the line is pulled through. Thus, it grasps the line tightly.

To insert the line 422 into the hollow 419, one of several techniques can be used involving the use of a hollow fid or a small-diameter pulling line. The fid or small line is passed through the hollow 419 and used to pull line 422 through it and out the end of the buoy. The pulling can be done in either direction.

FIG. 3C shows, schematically an embodiment of a flotation buoy that can be made from an elastomeric material, for instance by the process of rotational molding, also known as roto-molding. The entire buoy shown in FIG. 3C can be made from roto-molded polyvinyl chloride, according to known techniques. Thus, the main body portion 212 of the buoy would, in many significant respects, resemble a hollow body such as is used as a removable boat fender, such as are sold by West Marine of Watsonville, Calif. 95077-0070, under the tradename Third Mate Fenders.

A hollow body buoy, such as shown in FIG. 3C, has its annular chamber 113 filled with air or other gas that provides buoyancy. It must also be sealed or otherwise configured to maintain the gas within it, and to prevent water from entering, so that the expanded shape and displacement is maintained. The seal can be permanent, such as a molded seal, or it can use a valve, for refilling, or any other suitable mechanical closure.

Other suitable materials from which to make a buoy by roto-molding include, but are not limited to, polyethylene, EVA, PVC and urethane. These materials can be elastomeric, thermoplastic or thermoplastic elastomers. Material selection is discussed in more detail below.

Stiffness Profile

An important feature of the inventions disclosed herein is the stiffness profile in bending around an axis A (see FIGS. 3A and 4A) that is perpendicular to the direction of elongation E of the tapered buoy. Due to the geometry of the tapered region, the buoy fitted with the line 122 has a stiffness in bending about an axis A that increases gradually, from being essentially equal to the stiffness in bending of the line alone, at the line end, to essentially equal to that of a rigid, non-bending object, at the body portion 212. The entire body portion 212, including the transition region 216, and extending to the line end 214, is essentially rigid. The increase is due to the gradually thickening solid annular portion 217 of the tapered region 218 of the buoy, and the stiffness in bending of the enlarged hollow annular body portion 212.

It is generally important that the buoy have a stiffness profile that increases from the line end, to the free end, and that the buoy surface be free of any discontinuities that will promote snagging of the buoy by the body parts of a whale, such as the pectoral fin, flukes and mouth. Acceptable results are obtained with a stiffness profile defined by a mathematical curve that is at least geometric.

Solid Body Portion

It is also possible to fabricate a suitable buoy with a solid free end body portion 412, such as shown with reference to FIGS. 4A and 4B. For instance, the body portion 412 can be very similar to a widely used closed cell foam floatation buoy, available from Spongex Corporation of Shelton Conn. as discussed below. It is believed that these are made from a foam based on PVC (polyvinyl chloride) and NBR (Nitrile rubber, also known as poly(acrylonitrile-co-butadiene)). Materials selection is discussed below.

Mode of Operation

Figures 7A, 7B, 7C:
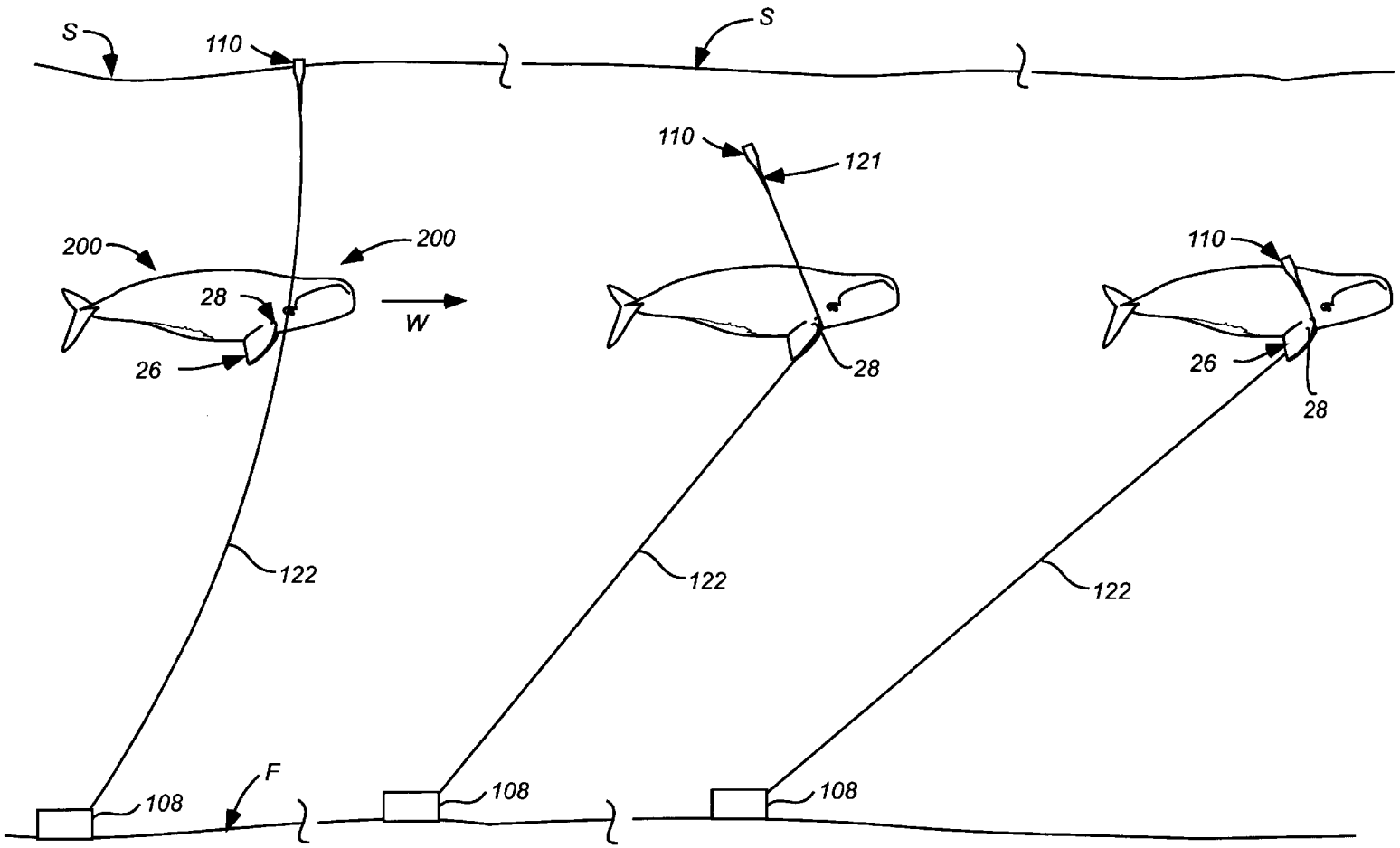
FIGS. 7A–7I, in three parts, shows schematically a whale moving through water, from left to right, as shown, as it encounters a line, that is anchored to an item of equipment at one end and a buoy float at the other end, and as the whale continues to move from left to right, gradually drawing the buoy: down toward the whale's pectoral fin (FIG. 7B); to touch the pectoral fin (FIG. 7C), bending around the fin (FIG. 7D); in front of the fin (FIG. 7E); around the bottom surface of the fin (FIG. 7F); under the fin (FIG. 7G); and as the buoy begins to return to the surface.

Before discussing additional embodiments of flotation buoys, its mode of operation is discussed. Interaction with a whale is shown schematically with reference to FIGS. 7A–7I. FIG. 7A shows a whale 200 (a Right whale) moving along the direction W (from left to right, as shown) approaching a line 122 that runs from a flotation buoy 110, which floats at the water surface S, down to an equipment component 108 that sits on the floor F below the body of water, for instance the ocean. The buoy 110 rests downstream of the equipment, in the flow of the tide and any additional current. As shown in FIG. 7B, when the whale 200 encounters the line 122, the line becomes taught and straight between the point of contact 28 on the whale and the equipment 108, below, and the buoy 110, above. The buoy 110 is pulled to below the water surface S, with its line end 121 pointed at the point of contact 28 with the whale.

As shown in FIG. 7C, as the whale moves forward, the line 122 slides along the whale's flipper root 28, drawing the buoy 110 closer toward the whale and its fin 26. If, for some reason, such as a large knot or a tangle in the line, or a crease or deep cut in the whale's fin, the line will not slide along the whale's fin, the buoy never reaches the whale, and the inventions disclosed herein do not come into play.

Figures 7D, 7E, 7F:
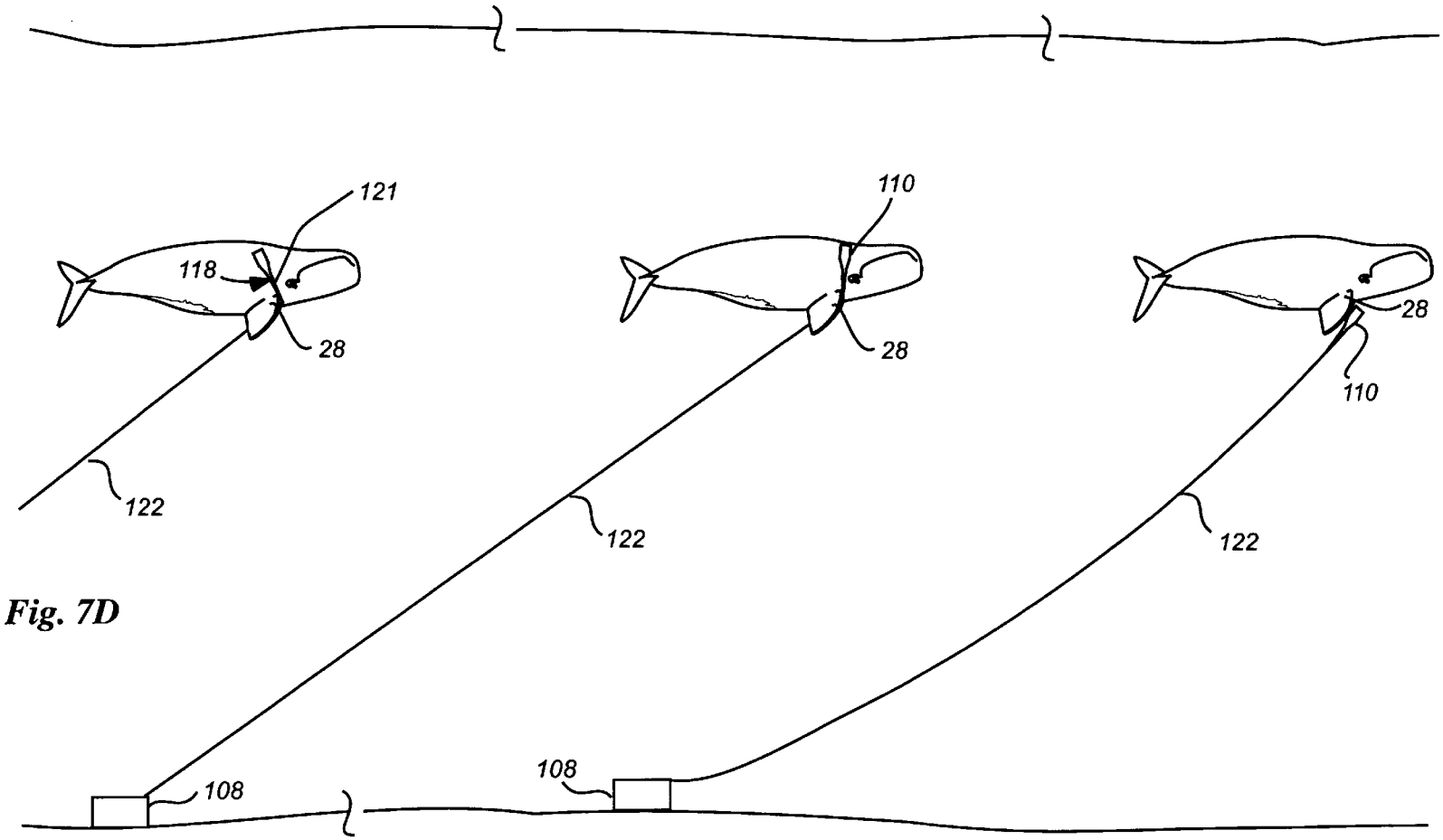

As shown in FIG. 7D, the line end 121 of the tapered region 118 encounters the whale's fin. This situation is also shown schematically with reference to FIG. 2A, which is an enlargement. In FIG. 2A, it can be seen that the flexible tip of the tapered region begins to wrap around the root of the fin, slightly, in much the same fashion as the bare line 122 wraps around the root.

As shown in FIG. 7E and FIG. 2B, at some point, as the tension in the line and the whale's forward motion pulls the tapered stem portion 118 downward, the balance of moments changes, so that the component of the tension that gives rise to a clockwise moment around the root 28 of the flipper (as shown in FIG. 2B) results in a moment that exceeds the opposing moment (counter-clockwise around the root) that results from the drag force. As a result, the buoy swings, or pivots, clockwise, around the fin root (which serves as a fulcrum), to the position shown in FIGS. 2B and 7E, so that no part of the buoy 110 or line 122 is urged to wrap further around the root 28.

Figures 7G, 7H, 7I:
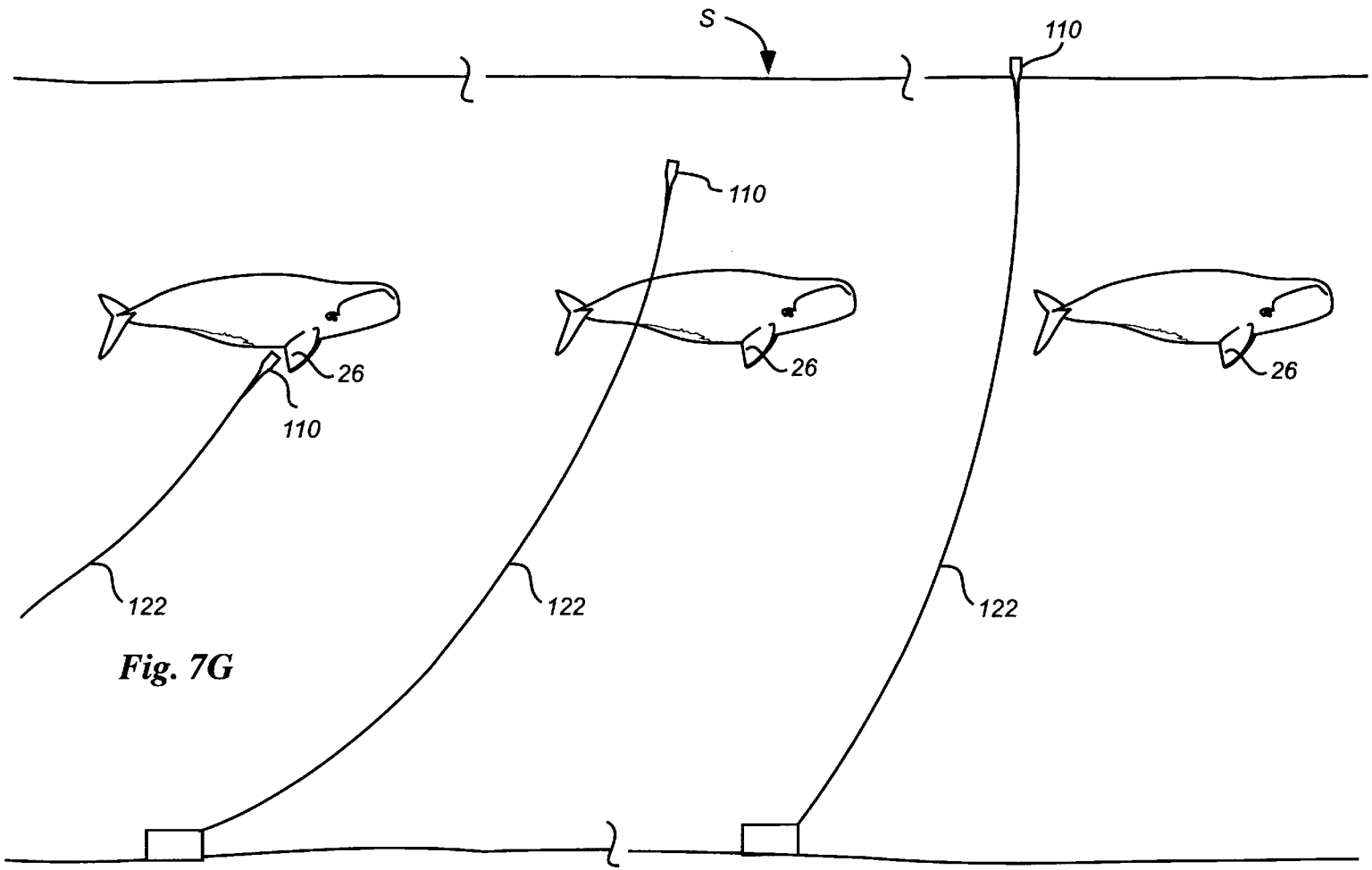

Continued forward motion of the whale, as shown in FIG. 7F allows the buoy 110 to pass below the root 28 and other structures of the fin 26. FIGS. 7G, 7H and 7I show, respectively, as the whale's fin 26 passes fully beyond the flotation buoy 110, allowing the buoy 110 to float toward (FIG. 7H), and up to the water surfaces (FIG. 7I).

It is important that the surface of the tapered buoy be generally smooth, so that there are no obstructions upon which the whale's fin can become lodged. By "smooth," it is meant, with any surface depressions or protrusions (collectively, surface irregularities) being either: smaller than a representative geometry of the whale's fin, so that the fin passes over any such small surface irregularities without becoming engaged by them; or larger than such a representative geometry, so that the fin moves along the surface of any such surface irregularity, tracking the surface much like a cam follower on a cam surface.

For instance, the dimples on a golf ball are too small to impede the progress of a whale's fin, and thus, a surface having dimples similar in size to that of a golf ball is smooth, as that term is used herein. Conversely, a surface with protruding pimples similar in size to that of dimples of a golf ball, but, convex, rather than concave, is smooth, as that term is used herein. This size of dimples on a golf ball is meant only to illustrate the point, and should not be considered to be restrictive. Depending on the size of a whale's fin, a person of ordinary skill in the art will understand how to limit the upper bound of the size of any surface irregularities, so that the whale's fin passes over the surface without becoming hung up due to the surface irregularities.

Further, a large buoy, such as for use with an anchor for very large structure, or a large channel marker, that has surface irregularities, but with a radius larger than approximately eight inches (20 cm), has irregularities that are so large that the whale fin root may trace out the irregularity, following along the surface, much like a cam follower on a cam surface, and also not become caught by the surface. This size of eight inches is meant only to illustrate the point, and should not be considered to be restrictive. Depending on the size of a whale's fin, a person of ordinary skill in the art will understand how to size any surface curvature so that the whale's fin follows it like a cam follower following a cam surface. Thus, the designer will need to take into account the typical size of the population of whales and their fins expected to encounter the buoy.

As a general guideline, not meant to be limiting, a surface having irregularities with a radius of smaller than approximately 1.3 in (0.5 cm) or larger than 8 in (20 cm), is considered to be smooth as used herein.

Thus, as used herein, a smooth surface may have surface irregularities that are small, if they are small enough, or large, if they are large enough, not to engage the whale. An example of a surface that is not smooth is that of a conventional buoy and stick, as shown in FIG. 1A. The interface between the line 22 and the eyelet 20 is not smooth, as used herein. Also, the interface between the lower stick 18, and the buoy bottom 16 is not smooth and can become an entanglement point.

Another important feature is that the stiffness against bending gradually increases, typically from near to zero at the extreme line end 121, and to very high, at the free end 114. This enables the line to be pulled around the whale's fin and for the line end 121 of the buoy to pass over the fin unimpeded. Eventually, as the stiffer portions of the tapered portion 118 encounter the fin, enough leverage is available that, in combination with the tension in the line, the free end of the flotation buoy begins to rotate around the flipper. This process is diagrammed in part by FIGS. 6A–6D.

FIGS. 6A–6D show, in enlarged fashion, the conformation of a representative flotation buoy of an invention hereof, as the whale body part moves forward in the direction of the arrow W. These figures show, in succession, how the tapered stem portion 118 begins to curve gently, rather than folding over in a crease, as it encounters the root 28 of the whale fin 26, and then, continues to remain uncreased, as the whale moves forward, and the buoy 110 moves downward, relative to the whale. At the time shown in FIG. 6C, the moment in the counterclockwise direction, around the fin, due to the drag force, remains larger than the moment in the clockwise direction, due to the tension in the line 122, in the opposite direction.

The moment $M_E$ is determined by the product of tension $T_E$ and the moment arm $A_E$. The moment $M_E$ counteracts the moment $M_D$, determined by the product of tension $F_D$ and the moment arm $A_D$.

Figure 6A:
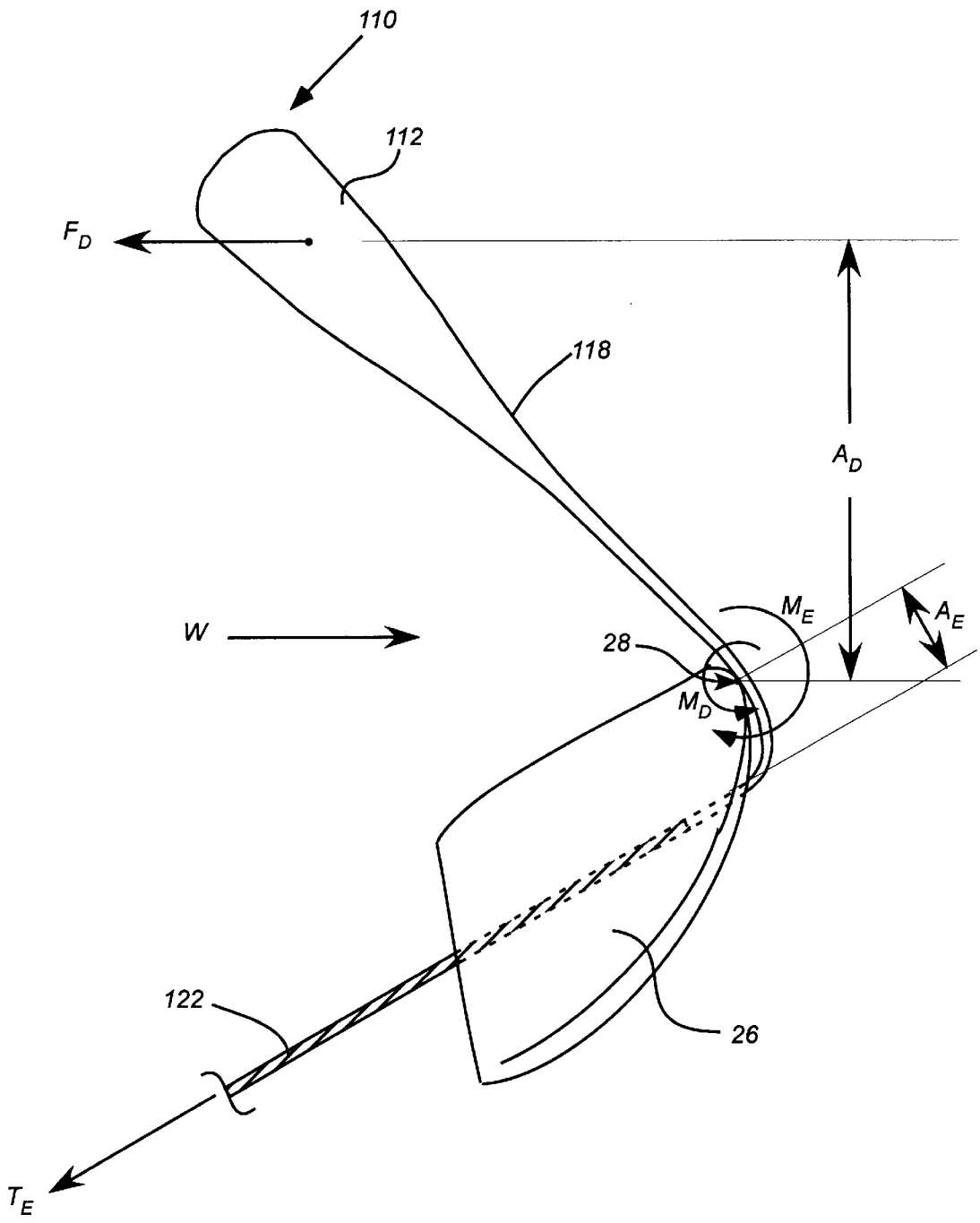
FIG. 6A shows, schematically, a side view of a buoy that embodies an aspect of an invention hereof, similar to that shown in FIG. 4A, as a moving object, such as a whale's pectoral fin, initially encounters a buoy's line end.
Figure 6B:
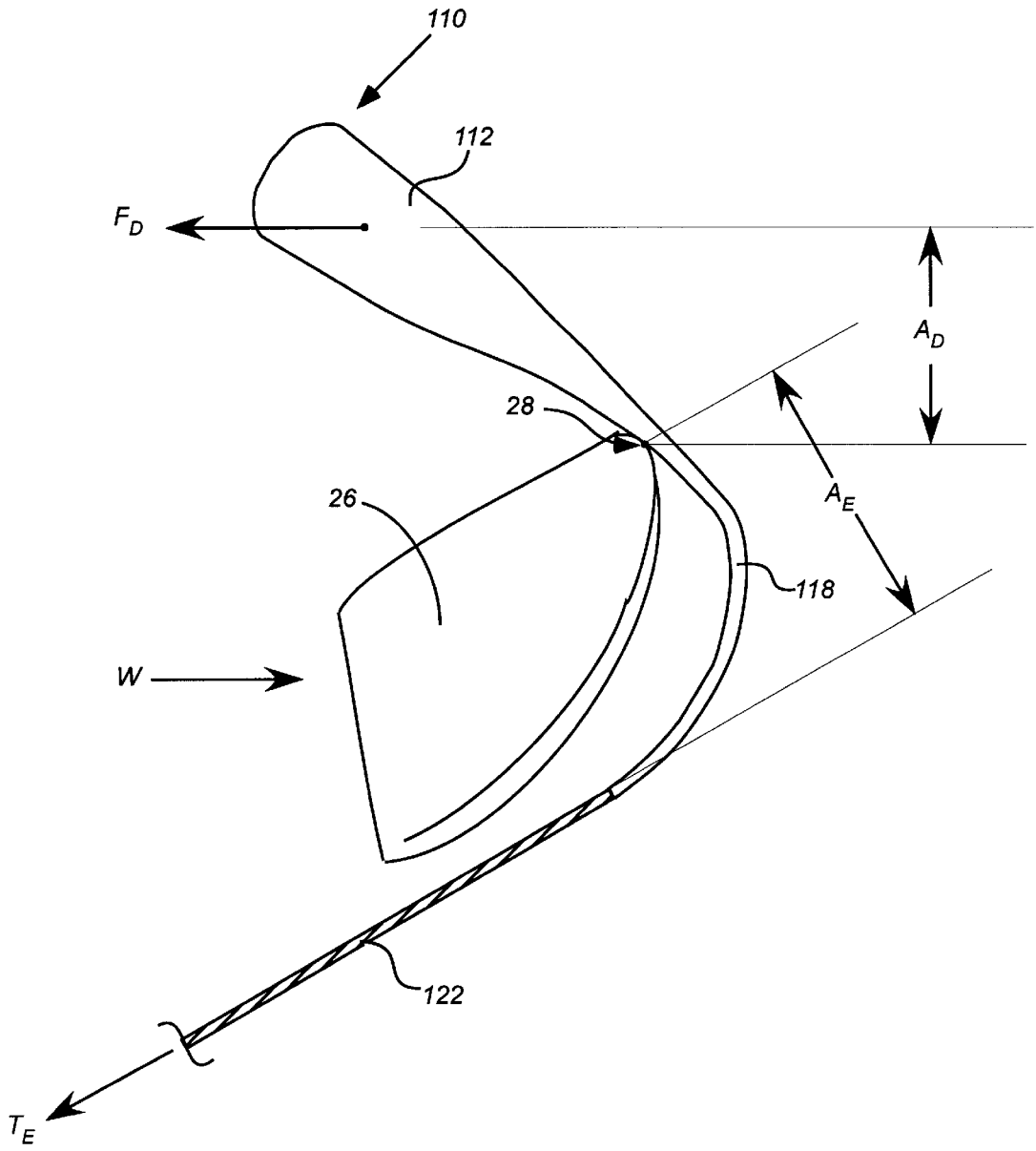
FIG. 6B shows, schematically, the buoy shown in FIG. 6A, as the moving object continues to move forward, and toward the buoy's free end.
Figure 6C:
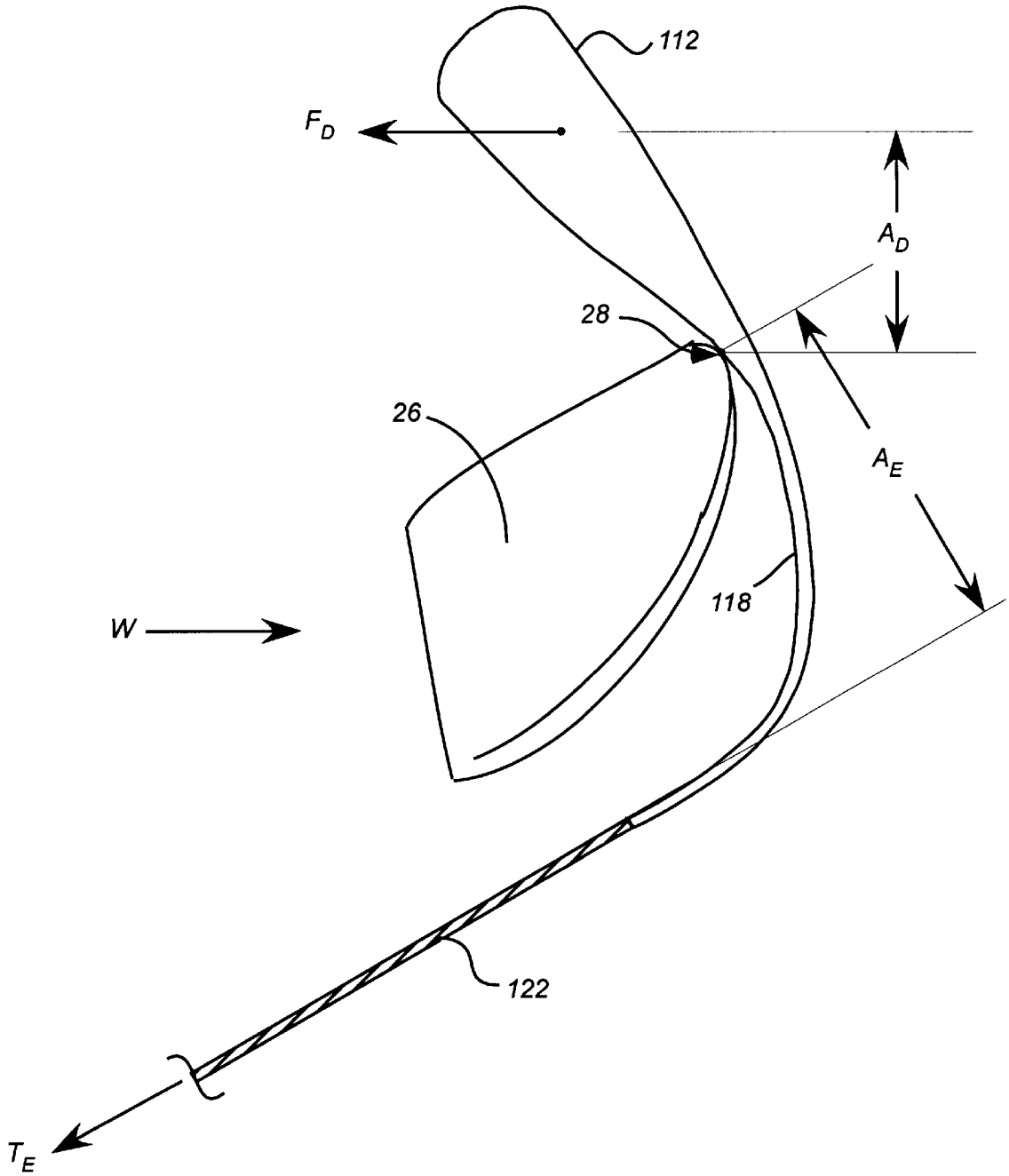
FIG. 6C shows, schematically, the buoy shown in FIG. 6A, as the moving object continues to move even more forward, while the balance of moments remains dominated by moments that tend wrap the line around the fin.
Figure 6D:
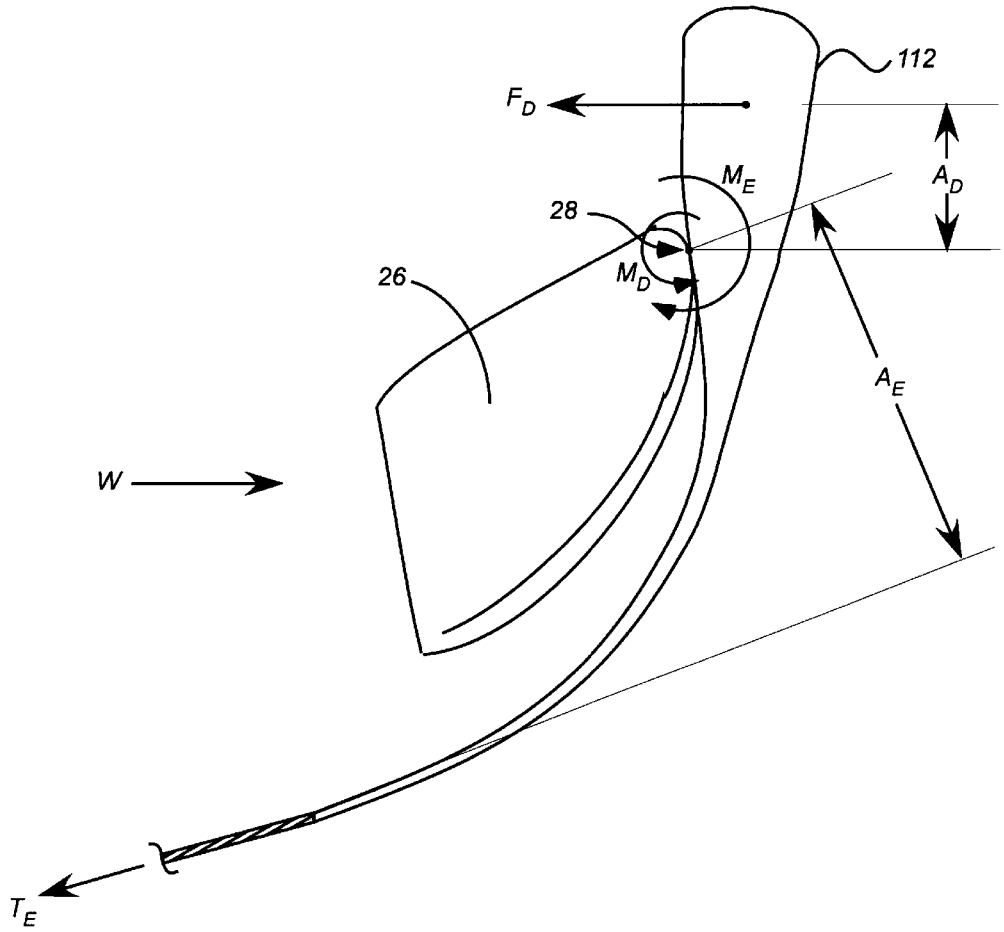
FIG. 6D shows, schematically, the buoy shown in FIG. 6A, after the moving object has moved far enough forward, and along the buoy toward its free end, so that the balance of torques becomes dominated by torques that tend to unwrap the buoy and line from around the fin.

At the time shown in FIG. 6D, this relation has reversed, and the moment $M_D$ in the counterclockwise direction, around the fin, due to the drag force, is now less than the moment $M_E$ in the clockwise direction, due to the tension in the equipment line and increased moment arm $A_E$, associated with the tension. Thus, the buoy body portion 112 is levered around the fin (in a clockwise direction) and can be pulled below, and beyond the whale, as shown in FIG. 7G.

As can be seen, as the entire line and buoy assembly slides along the whale's fin, the buoy body portion is drawn closer to the fulcrum (the root 28). The moment arm $A_D$ becomes shorter, and thus the contribution to the total moment due to the drag force decreases (to the extent that $F_D$ itself remains constant). Conversely, the moment arm $A_E$ becomes longer, and thus, the contribution to the total moment due to the tension $T_E$ in the equipment line, increases (also, to the extent that $T_E$ itself remains constant).

The smooth surface and the gradually increasing stiffness enhance the effect of each other, by allowing the line, and then the tapered buoy, to slide along the fin, without snagging (due to the smooth surface of the buoy) until the balance of moments discussed above is reached, that will enable the levering action.

The foregoing analysis does not take into account friction or other impeding forces that arise between the root 28 and the line 122, or the tapered stem 118. The smooth buoy surface is provided to reduce any such forces. The composition of the tapered stem 118 should be chosen so that it has a relatively low coefficient of friction, so that the buoy can slide along the fin root 28, despite the normal force engendered by the appropriate components of $F_D$ and $T_E$.

Although an embodiment has been described that has a stiffness at the line end that adds essentially nothing to the stiffness of the line, this need not be the case. It is also possible to provide a tapered buoy stem portion that adds moderate stiffness to that of the line alone, as long as the tapered stem portion is smooth.

Main Body Portion That is not Hollow

The embodiment shown with reference to FIG. 3C has an annular, hollow main body portion 213, which hollow is filled with air or other gas. It is also possible to use a flotation buoy 410 as shown in FIG. 4B, having a main body portion 412 that is not hollow, but is composed of rigid closed cell foam, for instance, a combination of PVC and NBR, as are commonly used to secure lobster pot lines along the New England Atlantic coast. Such buoys are available from Spongex Corp., of Shelton, Conn., under model number CB-5, CS-6 and LP-8. The models have diameters that range from 5 in. (12.2 cm) to 8 in. (20.3 cm) and lengths that range from 11 in. (28 cm) to 15 in. (36.6 cm). Such bodies are buoyant, durable, essentially rigid, and familiar to fishermen and boaters. They typically have a hollow axial channel through their body, to allow securing either by rope line or rods, such as shown in FIG. 1A. Materials selection is discussed below.

Such a rigid foam body is secured by suitable adhesive (such as epoxy, silicone or polysulphide) to a tapered stem portion 418, at an expanded bell transition section 416. The type of adhesive depends upon the materials of the main body portion and the stem portion, and can be selected based on tables published by adhesive manufacturers. The tapered stem and bell transition portions 418 and 416 may be essentially identical in cross section to the corresponding portions of the roto-molded embodiment, shown in FIG. 3C. They may be made, for instance, by providing a hollow external mold, and a central solid mold core.

For instance, to give an idea of shape and scale, satisfactory results have been had in prototyping, by using, as a mold for the tapered stem and transition portions, the bell and adjacent tubing of an ordinary brass trombone, with a core of a steel rod, tapered to the same taper as the hollow line chamber 219, shown in FIG. 3C. The bell shaped mold is treated with mold release, as is the core. Two part urethane casting liquid is prepared and poured into the mold, with the core held in place. The liquid is allowed to cure to a rubber-like hardness. Other suitable materials for a separate tapered stem portion are discussed below.

EXAMPLE

The following table shows the distance from the end of the solid body portion, and the inner diameter and outer diameter of the transition portion 416 and tapered portion 418, at one inch (2.54 cm) intervals, for a trombone bell-type mold prototype.

| Distance from Main Body intersection | | | | | |
|---|---|---|---|---|---|
| (in) | (cm) | O.D. (in) | O.D. (cm) | I.D. (in) | I.D. (cm) |
| 0 | 0 | 3.90 | 9.91 | 0.500 | 1.27 |
| 1 | 2.54 | 3.00 | 7.62 | 0.500 | 1.27 |
| 2 | 5.08 | 2.50 | 6.35 | 0.500 | 1.27 |
| 3 | 7.62 | 2.10 | 5.33 | 0.500 | 1.27 |
| 4 | 10.16 | 1.85 | 4.70 | 0.500 | 1.27 |
| 5 | 12.7 | 1.66 | 4.22 | 0.500 | 1.27 |
| 6 | 15.24 | 1.53 | 3.89 | 0.500 | 1.27 |
| 7 | 17.78 | 1.42 | 3.61 | 0.500 | 1.27 |
| 8 | 20.32 | 1.31 | 3.33 | 0.500 | 1.27 |
| 9 | 22.86 | 1.23 | 3.12 | 0.500 | 1.27 |
| 10 | 25.4 | 1.16 | 2.95 | 0.500 | 1.27 |
| 11 | 27.94 | 1.09 | 2.77 | 0.500 | 1.27 |
| 12 | 30.48 | 1.03 | 2.62 | 0.500 | 1.27 |
| 13 | 33.02 | 0.98 | 2.49 | 0.500 | 1.27 |
| 14 | 35.56 | 0.94 | 2.39 | 0.500 | 1.27 |
| 15 | 38.1 | 0.90 | 2.29 | 0.500 | 1.27 |
| 16 | 40.64 | 0.87 | 2.21 | 0.500 | 1.27 |
| 17 | 43.18 | 0.84 | 2.13 | 0.500 | 1.27 |
| 18 | 45.72 | 0.81 | 2.06 | 0.500 | 1.27 |
| 19 | 48.26 | 0.78 | 1.98 | 0.500 | 1.27 |
| 20 | 50.8 | 0.76 | 1.93 | 0.500 | 1.27 |
| 21 | 53.34 | 0.74 | 1.88 | 0.500 | 1.27 |
| 22 | 55.88 | 0.72 | 1.83 | 0.500 | 1.27 |
| 23 | 58.42 | 0.70 | 1.78 | 0.500 | 1.27 |
| 24 | 60.96 | 0.68 | 1.73 | 0.500 | 1.27 |
| 25 | 63.5 | 0.66 | 1.68 | 0.500 | 1.27 |
| 26 | 66.04 | 0.64 | 1.63 | 0.500 | 1.27 |
| 27 | 68.58 | 0.62 | 1.57 | 0.490 | 1.2446 |
| 28 | 71.12 | 0.60 | 1.52 | 0.470 | 1.1938 |
| 29 | 73.66 | 0.57 | 1.45 | 0.450 | 1.143 |
| 30 | 76.2 | 0.53 | 1.35 | 0.430 | 1.0922 |
| 31 | 78.74 | 0.49 | 1.24 | 0.410 | 1.0414 |
| 32 | 81.28 | 0.45 | 1.14 | 0.390 | 0.9906 |
| 33 | 83.82 | 0.41 | 1.04 | 0.370 | 0.9398 |
| 34 | 86.36 | 0.37 | 0.94 | 0.350 | 0.889 |
| (line end) 35 | 88.9 | 0.33 | 0.84 | 0.330 | 0.8382 |

Figure 5:
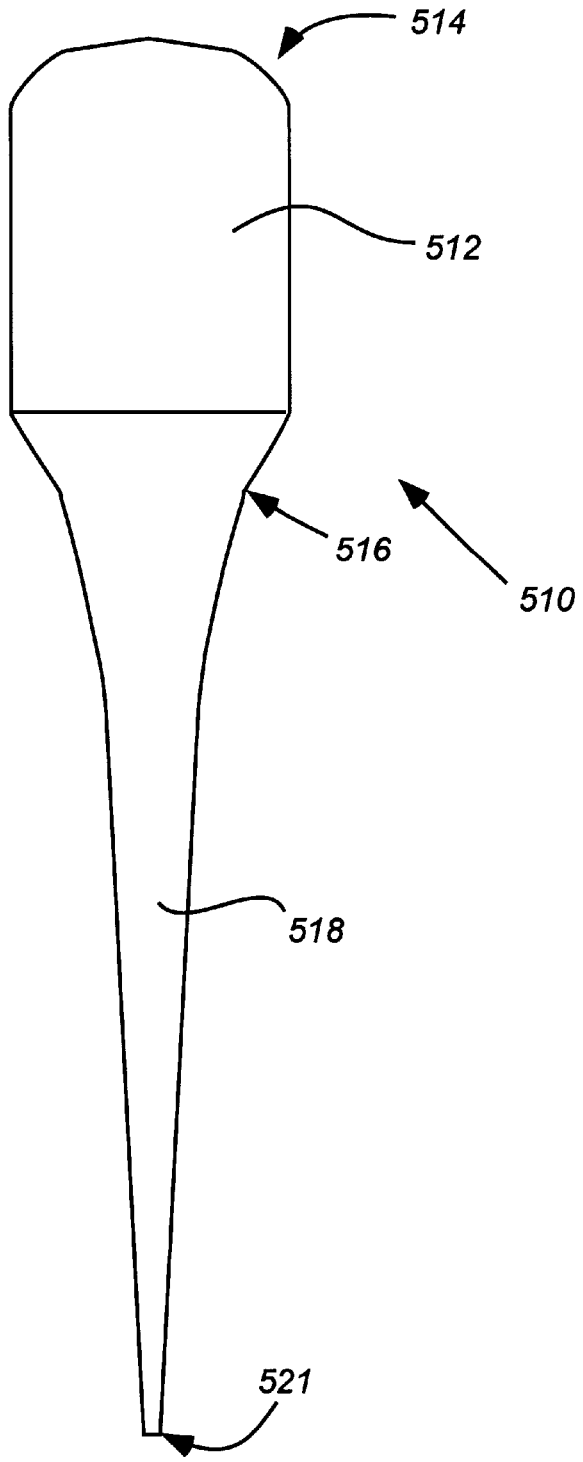
FIG. 5 is a schematic elevation view of a buoy that embodies an aspect of an invention hereof, similar to that shown in FIG. 4A, but having a relatively more abrupt, but still relatively gradual, taper approaching its free end.

FIG. 4A shows an embodiment with a relatively shallow taper angle, while FIG. 5 shows another embodiment with a steeper taper angle, and a slight change in angle at the transition region 516 between the solid body portion 512 and the tapered portion 518. Either is acceptable, as long as the discontinuity in angle is not so severe as to catch upon the whale's fin, or other part of anatomy.

The foregoing discussion has shown specific embodiments of a buoy that will minimize the risk of entanglement by a whale. Other physical manifestations of the invention may also achieve this goal. One important feature is that, along the direction of elongation of the buoy, which is also generally parallel to the direction in which the line extends to the equipment below, the surface of the buoy is smooth, as described above. A second, independent, important feature, which may be present alone, or in combination with the surface smoothness feature, is that the stiffness in bending around an axis that is perpendicular to the direction of elongation, gradually increase from a minimum at the line end, to a maximum at the free end. The minimum provides little additional resistance to bending than does the line alone, and the maximum presents an essentially unbendable body.

The surface of the buoy along a direction that is perpendicular to the direction of elongation, for instance around a circumference of the buoy, need not be smooth. For instance, the surface can be fluted with concavities, or ribbed with convexities, or both The cross-section may be generally circular, but need not be. It can be any shape, including three sided, eight sided, or any other shape, as long as the shape does not provide features that will snag the whale, or prevent the buoy stem from bending, with a gradually increasing resistance to bending.

General Goal is to Prevent Whale Struggling

Ideally, a flotation buoy of the present invention is so shaped and presents a stiffness profile, such that the whale will not even notice its presence, and will take no evasive action to move away from it. In most such cases, due to its smooth surface and stiffness profile, the buoy will simply be drawn along the whale's body, will remain unfolded, or uncreased relative to any part of the whale, and will simply be drawn past and beyond the whale. If the whale does not take evasive action, there is much less likelihood that the line will become wrapped around a part of the whale.

Whale Parts Other Than the Fin Becoming Entangled

The foregoing has discussed the problem with illustrations of a right whale, and its fin. It is also possible, of course, for other types of whales to encounter an equipment line and buoy, and for other parts of the whale's body to encounter the line. The right whale has a generally short fin, with a relatively broad (whale's front to whale's back) root portion, as compared to the width of the other portions of the pectoral fin. Humpback whales have a pectoral fin that has a much higher length to width ratio than that of the right whale. In other words, it is relatively long, from the root to the tip, and slender, from leading to trailing edges, as compared to the relatively short and stumpy fin of the right whale. Thus, a humpback whale fin may be more prone to entanglement with a line, due to its greater degree of mobility, and range of motion.

It has been suggested that a whale may also become entangled due to interaction with a buoy and the whale's mouth parts (jaw, baleen, teeth) or its tail fin (fluke). It is more difficult to generalize about the mode of entanglement of these body parts. However, it is believed that the relatively smooth surface and gradual taper of the buoys disclosed herein, as well as their stiffness profile, will also tend to minimize the risk of entanglement with these whale body parts.

Entanglement With Water Craft Components

The foregoing has discussed the manner in which the flotation buoys disclosed herein help to avoid whale entanglement. They also help to avoid entanglement with parts of boats and other water craft. Flotation buoy lines are often entangled with underwater parts of boats, such as the keel, rudder, propeller shafts, and underwater equipment, such as sonar transducers, etc. The relatively smooth surface of the flotation buoys disclosed herein, as well as their stiffness profile, will also help them to avoid the line attached thereto from becoming wrapped around, and entangled with such boat components.

Materials Selection Considerations

Various materials have been mentioned as candidates for the different parts of buoys of the invention. Some general considerations may aid the designer in choosing the proper materials for the required application.

In general, the entire buoy must float. Flotation can be achieved by using foamed materials, by using a buoy with hollow regions that are filled with air or other gas, or by using materials having a density such that they float when solid and unfoamed. On balance, foamed thermoplastic or rubber materials, or gas filled hollow bodies are best for this application.

The best solid materials for this consideration, from a standpoint of density alone, include solid polyethylene and solid polypropylene. To be useful, however the buoy must provide substantial flotation. In order to achieve enough buoyancy from a solid object, due to the relatively high densities of otherwise suitable materials, the object would need to be very large. The drag from such a large body would hinder the buoy's ability to be levered around the fin, as discussed above. Thus, solid materials are not the most preferable.

The material must also be salt water resistant. Polyethylene and polypropylene both fulfill this requirement, as does polystyrene.

Many of the commonly used buoys for lobster pots seen in New England waters are believed to be a closed-cell foam, based on a blend of polyvinyl chloride (PVC) and Nitrile rubber (also known as NBR, or poly(acrylonitrile-co-butadiene). The ratio of NBR and PVC may vary, with either being dominant, depending on the specifications of the application. Another possibility is to use a foam based on a plasticized PVC. However, it is believed that a PVC and NBR combination with more than half NBR, would withstand salt water better (NBR acting in effect as a permanent plasticizer).

Thus, these materials are suitable for fabrication of a separately formed, foamed main body portion, for designs where a main body portion is fixed with adhesive to a separate, tapered stem portion.

The stem portion need not be made from highly buoyant materials, because its displacement is much less than that of the main body portion. In fact, the stem portion can be made from negatively buoyant material, such as some urethanes or plasticized PVC, if suitable buoyancy is provided by the main body portion. Thus, a separately formed stem portion can be made from the materials listed above (polyethylene or polypropylene, or foamed plastic or rubber). Further, almost any plastic would work, to some extent. Also, a stiff rubber (e.g., high modulus versions of polyurethanes or thermoplastic elastomers) would also work. The following materials may be readily joined to a main body portion of a PVC and NBR expanded foam: PVC and ABS (acrylonitrile-butadiene-styrene).

The designer must also choose an adhesive to secure a separate main body portion to a separate stem portion. Adhesive choice will depend on the materials being joined. An intelligent choice can be made by referring to tables published by adhesive manufacturers.

Some of the designs discussed above can be roto-molded, also called rotationally molded. Most (80%) of roto-molding is conducted with different types of polyethylene (PE) (LDPE (low density), LLDPE (linear low density), HDPE (high density), and XLPE (cross-linked). To a lesser extent, roto-molding may be done with EVA (ethylene-vinyl acetate or poly (ethylene-co-vinyl acetate)), PVC, nylon, polycarbonate, polyesters and polypropylene. The choice will depend on the requirements for resistance to salt water (of which polyethylene is excellent), flotation (again, polyethylene is excellent), toughness, formability, etc. A rotationally molded buoy of an invention herein would typically be inflated with a gas, such as air. The inflated object provides displacement such that it floats. Thus, the material from which the buoy is fabricated need not have a density such that it would float itself, as buoyancy is provided by the displacement established by the gas filled hollow regions. Resolving these choices are within the skill of the skilled designer.

Concluding Statement of Generality

Inventions disclosed and described herein include flotation buoys, methods of deploying flotation buoys, buoys having a tapered line end, and buoys having a gradually increasing stiffness against bending, as described, from the line end to the free end. Additional inventions disclosed include flotation buoys that minimize the risk of entanglement with a whale, or water craft, such as a pleasure or commercial boat.

Partial Summary

Thus, this document discloses many related inventions.

One invention disclosed herein is a buoy, for use with a line that may be coupled to underwater equipment. The buoy comprises an elongated buoyant body comprising a main body portion, terminating in a free end, and having a transition region. A tapered stem portion is coupled to the main body portion at the transition region, and terminates in a line end that has an outer diameter that is approximately equal to the diameter of the line. The main body portion and the stem portion both are smooth along the direction of elongation.

The tapered stem portion and the main body portion together may have a profile of stiffness in bending around an axis that is perpendicular to its axis of elongation, which stiffness gradually increases from the line end toward the free end. The stiffness may increase according to a curve that is mathematically at least geometric. The line has a stiffness in bending around the axis that is perpendicular to its axis of elongation. The stiffness profile may be such that at the line end, the buoy has a stiffness that is approximately equal to the stiffness of the line alone.

In one version, the elongated buoyant body may comprise an annular solid portion, surrounding a hollow line chamber that extends from the line end to within the main body portion. The main body portion may be foamed material such as PVC, or PVC and NBR.

According to another embodiment, the main body portion may comprise a hollow region. The hollow region is filled with gas, typically air. It may be annular. There may be one or more hollow regions.

According to yet another embodiment, the hollow line chamber has a diameter that tapers from a maximum at the free end of the main body portion to a minimum at the line end of the stem portion. At the minimum, the diameter of the line chamber may be slightly less than the diameter of the line used with the buoy.

Some embodiments may have means for securing a line to the buoy, such as a hollow knot chamber, or a hollow line chamber that extends throughout the entire length of the buoy.

According to one embodiment, the buoyant body has a cross-section that has a circular outer perimeter, although this need not be. It can also be non-circular, triangular, etc.

The tapered stem portion can comprise an elastomeric material, or a thermoplastic material.

According to an important embodiment, the buoyant body is in whole or in part, rotationally molded. The stem portion and the main body portion can be rotationally molded together, or separately, and then joined. The stem portion can be molded separately from the main body portion, using a non-rotational molding system.

The buoyant body can comprise polyvinyl chloride, or polyethylene, among other materials.

Typically, the buoyant body has a stiffness profile such that at the free end, the buoy is essentially rigid.

Yet another embodiment of an invention disclosed herein is a buoy for use with a line that may be coupled to underwater equipment. The buoy comprises an elongated buoyant body comprising a main body portion, terminating in a free end, and having a transition region. A tapered stem portion is coupled to the main body portion at the transition region, and terminats in a line end that has an outer diameter that is approximately equal to the diameter of the line. The tapered stem portion and the main body portion together have a profile of stiffness in bending around an axis that is perpendicular to its axis of elongation, which stiffness gradually increases from the line end toward the free end.

Yet another embodiment of an invention disclosed herein is a method of making a buoy, for use with a line that may be coupled to underwater equipment. The method comprises providing a main body portion, terminating in a free end, and having a transition region and providing an elongated tapered stem portion, coupled to the main body portion at the transition region, and terminating in a line end that has an outer diameter that is approximately equal to the diameter of the line. Both the main body portion and the stem portion are smooth along the direction of elongation of the stem portion. The main body portion is joined to the tapered stem portion.

According to one embodiment, the main body portion and the stem portion are formed separately, and then adhered to each other.

According to another embodiment, the main body portion and the stem portion are formed together, by rotational molding.

Many techniques and aspects of the inventions have been described herein. The person skilled in the art will understand that many of these techniques can be used with other disclosed techniques, even if they have not been specifically described in use together.

This disclosure describes and discloses more than one invention. The inventions are set forth in the claims of this and related documents, not only as filed, but also as developed during prosecution of any patent application based on this disclosure. The inventor intends to claim all of the various inventions to the limits permitted by the prior art, as it is subsequently determined to be. No feature described herein is essential to each invention disclosed herein. Thus, the inventor intends that no features described herein, but not claimed in any particular claim of any patent based on this disclosure, should be incorporated into any such claim.

For instance, a buoy having a tapered stem portion, but that does not have a stiffness profile as discussed, is considered to be an invention. Similarly, a buoy that does not have a tapered stem portion, but that does have a stiffness profile that increases from a line end to a free end is considered to be an invention. Flotation buoys, as disclosed herein are considered to be inventions, and methods of using any such flotation buoys to secure equipment, or to avoid entanglement by whales or water craft, or both, are also considered to be inventions disclosed herein.

Some assemblies of hardware, or groups of steps, are referred to herein as an invention. However, this is not an admission that any such assemblies or groups are necessarily patentably distinct inventions, particularly as contemplated by laws and regulations regarding the number of inventions that will be examined in one patent application, or unity of invention. It is intended to be a short way of saying an embodiment of an invention.

An abstract is submitted herewith. It is emphasized that this abstract is being provided to comply with the rule requiring an abstract that will allow examiners and other searchers to quickly ascertain the subject matter of the technical disclosure. It is submitted with the understanding that it will not be used to interpret or limit the scope or meaning of the claims, as promised by the Patent Office's rule.

The foregoing discussion should be understood as illustrative and should not be considered to be limiting in any sense. While the inventions have been particularly shown and described with references to preferred embodiments thereof, it will be understood by those skilled in the art that various changes in form and details may be made therein without departing from the spirit and scope of the inventions as defined by the claims.

The corresponding structures, materials, acts and equivalents of all means or step plus function elements in the claims below are intended to include any structure, material, or acts for performing the functions in combination with other claimed elements as specifically claimed.

What is claimed is:

1. A method of making a buoy, for use with a line that may be coupled to underwater equipment, said method comprising:

a. providing a main body portion, terminating in a free end, and having a transition region;

b. providing an elongated tapered stem portion, coupled to said main body portion at said transition region, and terminating in a line end that has an outer diameter that is approximately equal to the diameter of said line, both said main body portion and said stem portion being smooth along said direction of elongation of said stem portion, said step of providing a tapered stem portion comprising:

i. providing an external mold, having a tapered cross section;

ii. providing an internal core mold, and maintaining said core spaced apart from said external mold, defining an annular region therebetween;

iii. filling said annular region with liquid molding material; and iv. allowing said molding material to harden; and c. joining said main body portion to said tapered stem portion.

2. A buoy, for use with a line that may be coupled to underwater equipment, said buoy comprising an elongated buoyant body comprising:

a. a main body portion, terminating in a free end, and having a transition region;

b. a tapered stem portion, coupled to said main body portion at said transition region, and terminating in a line end that has an outer diameter that is approximately equal to the diameter of said line, said tapered stem portion and said main body portion together having a profile of stiffness in bending around an axis that is perpendicular to its axis of elongation, which stiffness gradually increases from said line end toward said free end; and c. said main body portion and said stem portion both being smooth along said direction of elongation.

3. The buoy of claim 2, said line having a stiffness in bending around said axis that is perpendicular to its axis of elongation, wherein said stiffness profile is such that at said line end, said buoy has a stiffness that is approximately equal to the stiffness of said line alone.

4. The buoy of claim 2, said elongated buoyant body comprising an annular solid portion, surrounding a hollow line chamber that extends from said line end to within said main body portion.

5. The buoy of claim 2, said main body portion comprising foamed material.

6. The buoy of claim 5, said foamed material comprising polyvinyl chloride.

7. The buoy of claim 5, said foamed material comprising a foam based on polyvinyl chloride and nitrile rubber.

8. The buoy of claim 2, said main body portion comprising a relatively solid body, surrounding a hollow line chamber.

9. The buoy of claim 2, said main body portion comprising a hollow region.

10. The buoy of claim 9, said hollow region comprising a gas filled region.

11. The buoy of claim 2, said main body portion comprising a hollow annular portion.

12. The buoy of claim 11, said hollow annular portion comprising a gas filled portion.

13. The buoy of claim 2, wherein said stiffness profile is characterized by a curve that is at least geometric.

14. The buoy of claim 2, further comprising means for securing said line to said buoy.

15. The buoy of claim 14, said means for securing said line to said buoy comprising a knot socket within said buoyant body.

16. The buoy of claim 2, said buoyant body having a cross-section that has a circular outer perimeter.

17. The buoy of claim 2, said buoyant body having a cross-section that has a non-circular outer perimeter.

18. The buoy of claim 2, said tapered stem portion comprising an elastomeric material.

19. The buoy of claim 2, said tapered stem portion comprising a thermoplastic material.

20. The buoy of claim 2, said buoyant body comprising a rotationally molded body.

21. The buoy of claim 2, said tapered stem portion comprising a rotationally molded body.

22. The buoy of claim 2, said tapered stem portion and said main body portion comprising separate bodies, further comprising an adhesive that couples said main body portion to said tapered stem portion.

23. The buoy of claim 2, said buoyant body comprising polyvinyl chloride.

24. The buoy of claim 2, said buoyant body comprising polyethelyne.

25. The buoy of claim 2, further comprising, coupled to said free end, a grab handle.

26. The buoy of claim 2, said main body portion having a substantially constant diameter, over a length along said direction of elongation of about equal to said diameter.

27. The buoy of claim 2, said main body portion being approximately cylindrical.

28. The buoy of claim 2, wherein said stiffness profile is such that at said free end, said buoy has a stiffness that is essentially rigid.

29. The buoy of claim 28, wherein said stiffness profile is such that at said transition region, said buoy has a stiffness that is essentially rigid.

30. A buoy, for use with a line that may be coupled to underwater equipment, said buoy comprising an elongated buoyant body comprising:

a. a main body portion, terminating in a free end, and having a transition region;

b. a tapered stem portion, coupled to said main body portion at said transition region, and terminating in a line end that has an outer diameter that is approximately equal to the diameter of said line;

c. said main body portion and said stem portion both being smooth along said direction of elongation; and d. an annular solid portion, surrounding a hollow line chamber that extends from said line end to within said main body portion, said hollow line chamber having a diameter that tapers from a maximum at said free end of said main body portion to a minimum at said line end of said stem portion.

31. The buoy of claim 30, said line having a diameter, said hollow line chamber having a diameter that is slightly less than the diameter of said line.

32. A buoy, for use with a line that may be coupled to underwater equipment, said buoy comprising an elongated buoyant body comprising:

a. a main body portion, terminating in a free end, and having a transition region;

b. a tapered stem portion, coupled to said main body portion at said transition region, and terminating in a line end that has an outer diameter that is approximately equal to the diameter of said line; and c. wherein said tapered stem portion and said main body portion together have a profile of stiffness in bending around an axis that is perpendicular to its axis of elongation, which stiffness gradually increases from said line end toward said free end.

33. The buoy of claim 32, said line having a stiffness in bending around said axis that is perpendicular to its axis of elongation, wherein said stiffness profile is such that at said line end, said buoy has a stiffness that is approximately equal to the stiffness of said line alone.

34. The buoy of claim 32, said elongated buoyant body comprising an annular solid portion, surrounding a hollow line chamber that extends from said line end to within said main body portion.

35. The buoy of claim 34, said hollow line chamber having a diameter that tapers from a maximum at said free end of said main body portion to a minimum at said line end of said stem portion.

36. The buoy of claim 35, said line having a diameter, said hollow line chamber having a diameter that is slightly less than the diameter of said line.

37. The buoy of claim 32, said main body portion comprising a hollow region.

38. The buoy of claim 37, said hollow region comprising a gas filled region.

39. The buoy of claim 32 said main body portion comprising a hollow annular portion.

40. The buoy of claim 39, said hollow annular portion comprising a gas filled portion.

41. The buoy of claim 32, wherein said stiffness profile is characterized by a curve that is at least geometric.

42. The buoy of claim 32, said buoyant body having a cross-section that has a non-circular outer perimeter.

43. The buoy of claim 32, said buoyant body comprising a rotationally molded body.

44. The buoy of claim 32, said tapered stem portion comprising a rotationally molded body.

45. The buoy of claim 32, said tapered stem portion and said main body portion comprising separate bodies, further comprising an adhesive that couples said main body portion to said tapered stem portion.

46. The buoy of claim 32, further comprising, coupled to said free end, a grab handle.

47. The buoy of claim 46, wherein said stiffness profile is such that at said transition region, said buoy has a stiffness that is essentially rigid.

48. The buoy of claim 32, wherein said stiffness profile is such that at said free end, said buoy has a stiffness that is essentially rigid.

49. A method of making a buoy, for use with a line that may be coupled to underwater equipment, said method comprising:

a. providing a main body portion, terminating in a free end, and having a transition region;

b. providing an elongated tapered stem portion, coupled to said main body portion at said transition region, and terminating in a line end that has an outer diameter that is approximately equal to the diameter of said line, said step of providing a tapered stem portion comprising:

i. providing an external mold, having a tapered cross section;

ii. providing an internal core mold, and maintaining said core spaced apart from said external mold, defining an annular region therebetween;

iii. filling said annular region with liquid molding material; and iv. allowing said molding material to harden; and c. joining said main body portion to said tapered stem portion.

50. The method of claim 49, said step of joining said main body portion to said stem portion comprising applying an adhesive between said main body portion and said stem portion and contacting them together.

51. The method of claim 49, said step of joining said main body portion to said stem portion comprising the step of simultaneously rotationally molding both in a single mold.

52. The method of claim 51, said step of rotationally molding comprising rotationally molding a polyvinyl chloride buoyant body.

53. The method of claim 51, said step of rotationally molding comprising rotationally molding a polyethylene buoyant body.

54. A buoy, for use with a line that may be coupled to underwater equipment, said buoy comprising an elongated buoyant body comprising:

a. a main body portion, terminating in a free end, and having a transition region;

b. a tapered stem portion, coupled to said main body portion at said transition region, and terminating in a line end that has an outer diameter that is approximately equal to the diameter of said line; and c. an annular solid portion, surrounding a hollow line chamber that extends from said line end to within said main body portion, said hollow line chamber having a diameter that tapers from a maximum at said free end of said main body portion to a minimum at said line end of said stem portion.

* * * * *